US005544394A

United States Patent [19]

Yaguramaki

[11] Patent Number: 5,544,394

[45] Date of Patent: Aug. 13, 1996

[54] AUTO-LOCK SLIDER FOR CONCEALED SLIDE FASTENER

[75] Inventor: Iwao Yaguramaki, Toyama, Japan

[73] Assignee: YKK Corporation, Tokyo, Japan

[21] Appl. No.: 555,220

[22] Filed: Dec. 7, 1995

Related U.S. Application Data

[63] Continuation of Ser. No. 285,732, Aug. 4, 1994, abandoned.

[30] Foreign Application Priority Data

Aug. 31, 1993 [JP] Japan ..... 5-047301 U

[51] Int. Cl.[6] ..... A44B 19/30

[52] U.S. Cl. ..... 24/424

[58] Field of Search ..... 24/424, 421, 420, 24/422, 423, 425

[56] References Cited

U.S. PATENT DOCUMENTS

| | | | |
|---|---|---|---|
| 2,215,746 | 9/1940 | Sundback | 24/424 |
| 2,502,901 | 4/1950 | Taberlet . | |
| 3,793,684 | 2/1974 | Moertel . | |
| 3,924,306 | 12/1975 | Oda . | |
| 4,102,022 | 7/1978 | Aoki | 24/424 |

FOREIGN PATENT DOCUMENTS

| | | | |
|---|---|---|---|
| 997775 | 1/1952 | France . | |
| 2254287 | 7/1975 | France . | |
| 2368911 | 5/1978 | France . | |
| 2045131 | 5/1971 | Germany . | |
| 7416344 | 6/1975 | Netherlands | 24/423 |
| 853905 | 11/1960 | United Kingdom | 24/424 |
| 978831 | 12/1964 | United Kingdom | 24/424 |

*Primary Examiner*—James R. Brittain
*Attorney, Agent, or Firm*—Hill, Steadman & Simpson

[57] ABSTRACT

An auto-lock slider, for a concealed slide fastener, comprises: a slider body having a guide lug having in its upper portion a locking-lever-receiving groove and a leaf-spring-receiving portion; a locking lever received in the locking-lever-receiving groove, the locking lever having at one end a locking claw and at the other end an anchor portion; a horizontal U-shape leaf spring covering the locking lever at a side toward the anchor portion in such a manner that the anchor portion is pivotably held within the groove and the locking claw is resiliently urged to project into a coupling-element-guide channel in the body. Since the number of components of the slider is small, the slider can be assembled simply.

4 Claims, 5 Drawing Sheets

AUTO-LOCK SLIDER FOR CONCEALED SLIDE FASTENER

This is a continuation, of application Ser. No. 08/285,732, filed Aug. 4, 1994 abandoned.

BACKGROUND OF THE INVENTION

1. Field of the Invention

This invention relates to an auto-lock slider for a concealed slide fastener, and more particularly to such an auto-lock slider in which a locking lever with a locking claw and a leaf spring as a resilient member are separate from each other and in which one end of the locking lever and the leaf spring are received in the upper portion of a guide lug of a slider body.

2. Description of the Related Art

In a conventional auto-lock slider for a concealed slide fastener, as shown in FIG. 9 of the accompanying drawings, a slider body 30 has in the upper portion of a guide lug 31 for guiding a locking lever 32, a vertical groove 33 for receiving the locking lever 32, and the guide lug 31 has in its front portion a hole 35 in which a coil spring 34 is received. The coil spring 34 is pressed against a rear end of the locking lever 32. The locking lever 32 is pivotally mounted at its center and has at its front end a locking claw 36 in the base of which a pintle 37 of a pull tab is inserted so that the locking claw 36 of the locking lever 32 can pivotally move vertically.

In another conventional auto-lock slider (Republic of China Patent Publication No. 20633), as shown in FIG. 10, a slider body 41 has in the upper portion of a guide lug 42 a vertical groove 44 for receiving a generally M-shape locking lever 43, and the guide lug 42 has in its center a hole 46 in which a coil spring 45 is received. The coil spring 45 is held in the hole 46 by clinching the upper end of the hole 46 in such a manner that the coil spring 45 is pressed against a central recess of the M shape of the locking lever 43. A pintle 48 of a pull tab is inserted in the base of a locking claw 47 of the locking lever 43 so that the locking claw 47 can pivotally move vertically.

In assembling of the first-named conventional auto-lock slider, firstly the coil spring 34 is received in the hole 35 and then the locking lever 32 is inserted into the vertical groove 33 with the rear end pressed downwardly until a pivot hole 38 of the locking lever 32 is aligned with pivot holes 39 of the guide lug 31, whereupon a hollow pivot 40 is inserted through the pivot holes 38, 39 and is then clinched at opposite ends. Partly since the aligning of the pivot holes and the clinching of the hollow pivot require complex works, and partly since the number of components of the slider is large, an inexpensive slider could not be obtained.

With the second-named conventional auto-lock slider, since the locking lever 43 is held in position simply by pressing its center with the coil spring, the positioning of the locking lever 43 is very unstable. More specifically, since an anchor portion 49 of the locking lever 43 is not held from the upper side with anything, the anchor portion 49 will float upwardly against the resilience of the coil spring 45 about the pivot 48 as a force is exerted on the front end of the locking lever 43, namely, as a force is exerted on the slider in the direction of opening the slide fastener without operating the pull tab, thus disconnecting the locking lever 43 from the guide lug 42 by accident, which would by a cause for failure. Further, this conventional slider is very laborious to assemble.

SUMMARY OF THE INVENTION

It is an object of this invention to provide an auto-lock slider, for a concealed slide fastener, in which a locking claw of a locking lever is covered and protected from the upper side by a leaf spring so that the locking lever is prevented from being removed, thus guaranteeing a stable locking function and requiring only a simple assembling work.

According to the invention, an auto-lock slider, for a concealed slide fastener comprises a slider body having a guide lug, for guiding a locking lever, which has in its upper portion a locking-lever-receiving groove and a leaf-spring-receiving portion, and the locking lever received vertically in the locking-lever-receiving groove and having at one end a locking claw and at the other end an anchor portion. The auto-lock slider also comprises a leaf spring having a shape such that one end is deformable to a more extent compared to the other end, the leaf spring covering the locking lever at a side toward the anchor portion in such a manner that the anchor portion is pivotably held within the groove and the locking claw is resiliently urged to project into a coupling-element-guide channel in the body, the leaf spring being resiliently in contact with the locking lever with the more deformable end facing toward the locking claw. The auto-lock slider further comprises a pull tab connector having a pintle inserted in a base of the locking claw.

Preferably, the leaf-spring-receiving portion has front and rear holding projections spaced from one another and projecting from respective upper surfaces of opposite side walls of the locking lever-receiving groove, and the leaf spring has a horizontal U shape composed of a wide upper plate and a narrow resilient strip extending downwardly from the upper plate. The upper plate has a pair of side arms projecting centrally from opposite sides of the upper plate. The upper plate of the leaf spring is held in position by inserting the side arms between the front and rear holding projections and then clinching the front and rear holding projections over the side arms, the resilient strip being pressed against an upper surface of the locking lever.

Further, the leaf-spring-receiving portion has front and rear holding projections spaced from one another and projecting from respective upper surfaces of opposite side walls of the locking lever-receiving groove the leaf spring, including a main plate having at its center and resilient strip punched out by a longitudinally elongated horizontal U-shape cut and bent downwardly. The main plate has a pair of side arms projecting centrally from opposite sides of the main plate. The main plate of the leaf spring is held in position by inserting the side arms between the front and rear holding projections and then clinching the front and rear holding projections over the side arms, the resilient strip being pressed against an upper surface of the locking lever.

In operation, partly since the locking lever is covered at a side toward the anchor portion by the leaf spring and partly since the leaf spring is pressed against the locking lever with the more deformable end of the leaf spring facing toward the locking claw, the locking lever will float upwardly against the resilience of the leaf spring when the pull tab is pulled during the sliding operation of the slider, thus causing the locking claw to be disconnected from a pair of interengaged coupling element rows to allow the slider to slide along the coupling element rows in either of the forward and backward directions.

When the pull tab is released, the locking claw of the locking lever is forced into an inter-coupling-element space of the slide fastener under the resilience of the leaf spring to prevent the movement of the slider. Since the anchor portion of the locking lever is pressed and covered by the less deformable portion of the leaf spring, the anchor portion is free from being removed from the slider body 1 while the slider is pulled.

DETAILED DESCRIPTION

Embodiments of an auto-lock slider for a concealed slide fastener according to this invention will now be described in detail with reference to the accompanying drawings.

Figure 9:
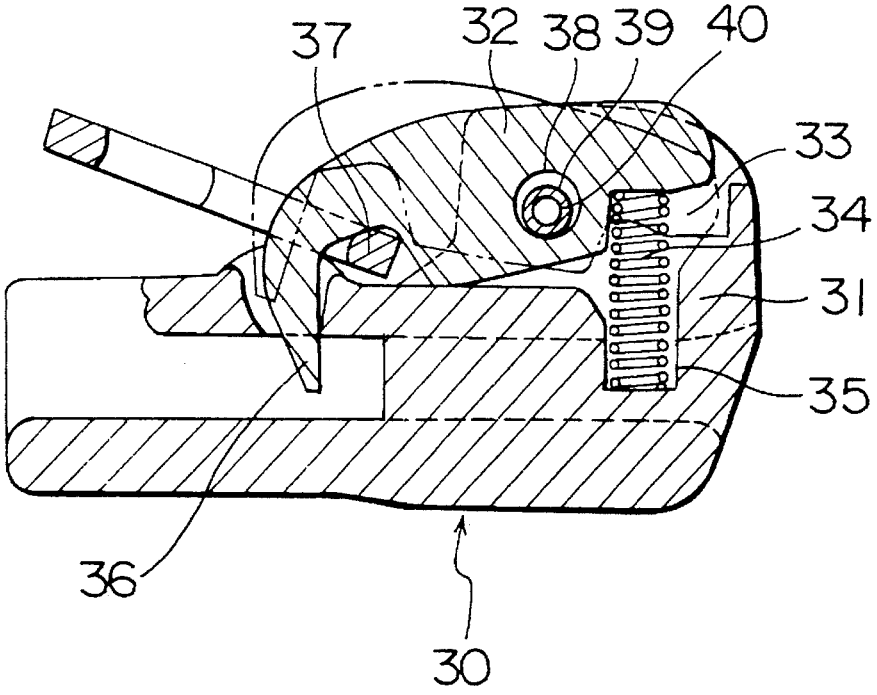
FIG. 9 (PRIOR ART)
FIG. 9 is a longitudinal cross-sectional view of a conventional auto-lock slider, for a concealed slide fastener, disclosed in a prior art reference.
Figure 10:
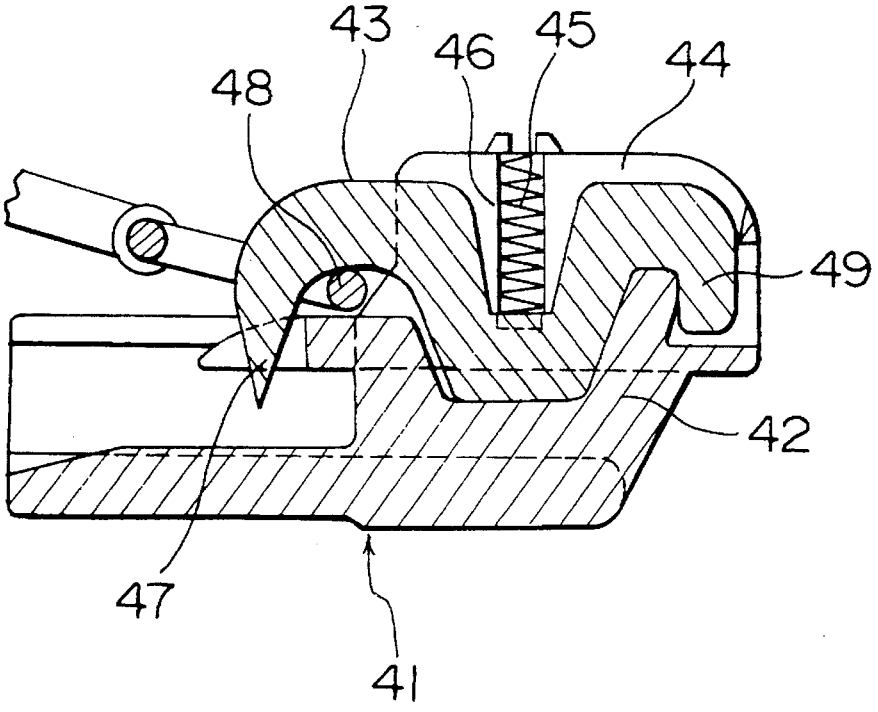
FIG. 10 (PRIOR ART)
FIG. 10 is a longitudinal cross-sectional view of another conventional auto-lock slider, for a concealed slide fastener, disclosed in another prior art reference.

The auto-lock slider of the invention is an improvement of the conventional sliders of FIGS. 9 and 10. This auto-lock slider comprises a slider body 1 having a guide lug 2 for guiding a locking lever 3 in the upper portion of which a locking-lever-receiving groove 4 is formed for receiving the locking lever 3, the locking-lever-receiving groove 4 having in its bottom a recess 5. The guide lug 2 has in its upper portion a leaf-spring-receiving portion 7 which has front and rear holding projections 8 spaced from one another and projecting from outer sides of respective upper surfaces of opposite side walls of the locking leaf-receiving groove 4, there being flat portions 9 between the holding projections 8. The slider body 1 also has at a position a locking claw hole 10 located on an extension of the locking-lever-receiving groove 4 and communicating with a coupling-element-guide channel 11.

The locking lever 3 has a locking claw 12 projecting perpendicularly from one end and an anchor portion 13 projecting from the other end in the same direction as the locking claw 12. The locking claw 12 has a curved base in which a pintle 16 of a connecting ring 15 for connecting a pull tab 14 to the slider body 1 is inserted.

Figure 4:
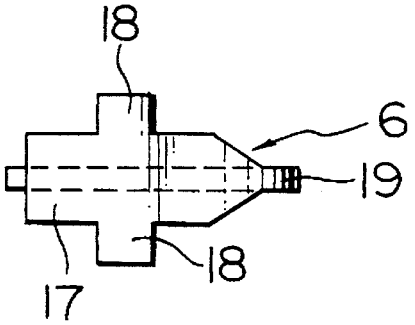
FIG. 4 is a plan view of a U-shape leaf spring.
Figure 5:
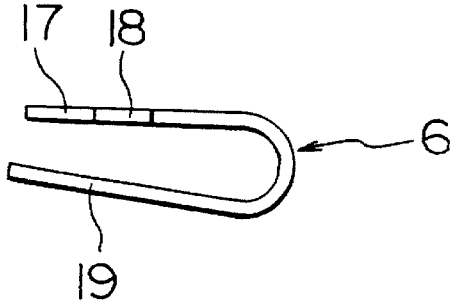
FIG. 5 is a side view of the U-shape leaf spring of FIG. 4.
Figure 7:
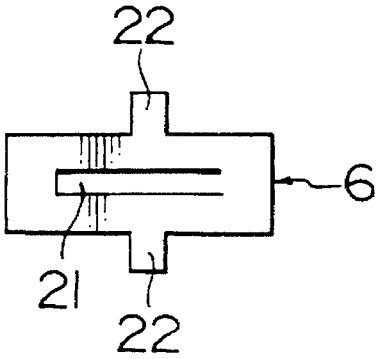
FIG. 7 is a plan view of an almost closed V-shape left spring.

FIGS. 4 and 7 show two typical forms of the leaf spring 6. The leaf spring 6 of FIG. 4 has a horizontal U shape, as viewed in side elevation in FIG. 5, which is composed of a wide upper plate 17 and a narrow resilient strip 19 bent and projecting from a rear end of the upper plate 17. The upper plate 17 has a pair of side arms 18 projecting centrally from opposite sides of the upper plate 17. The free end portion of the resilient strip 19 is more deformable, compared to the base portion.

Figure 8:
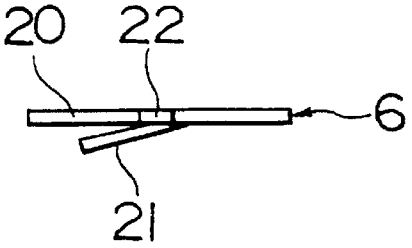
FIG. 8 is a side view of the almost closed V-shape leaf spring of FIG. 7.

The leaf spring 6 of FIG. 7 has an almost closed horizontal V shape, as viewed in side elevation in FIG. 8, which has a rectangular main plate 20 having at its center a slant resilient strip 21 punched out by a longitudinally elongated horizontal U-shape cut and bent downwardly. The main plate 20 has a pair of side arms 22 projecting centrally from opposite sides of the main plate 20. The free end portion of the resilient 21 is more deformable, compared to the base portion.

Figure 1:
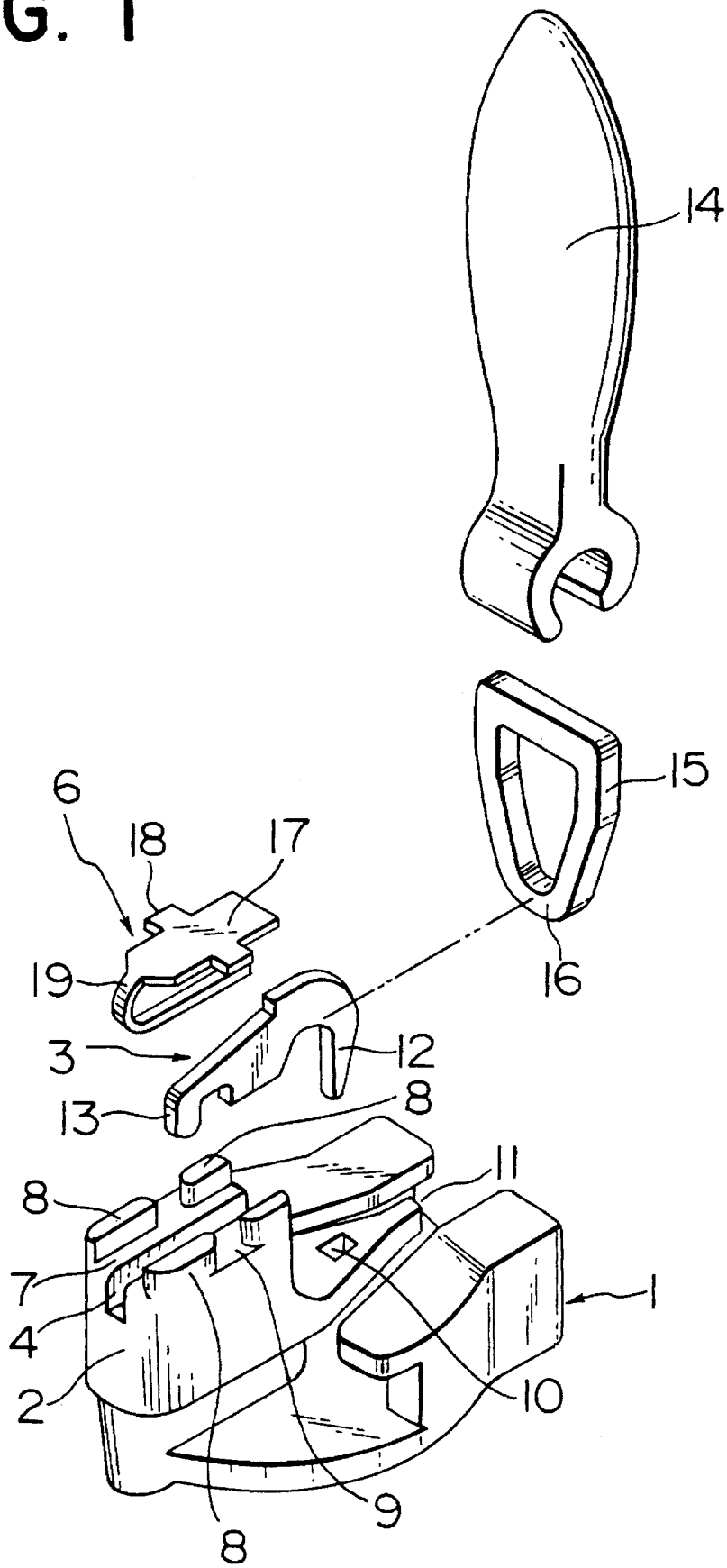
FIG. 1 is an exploded perspective view of an auto-lock slider for a concealed slide fastener according to one embodiment of this invention.
Figure 2:
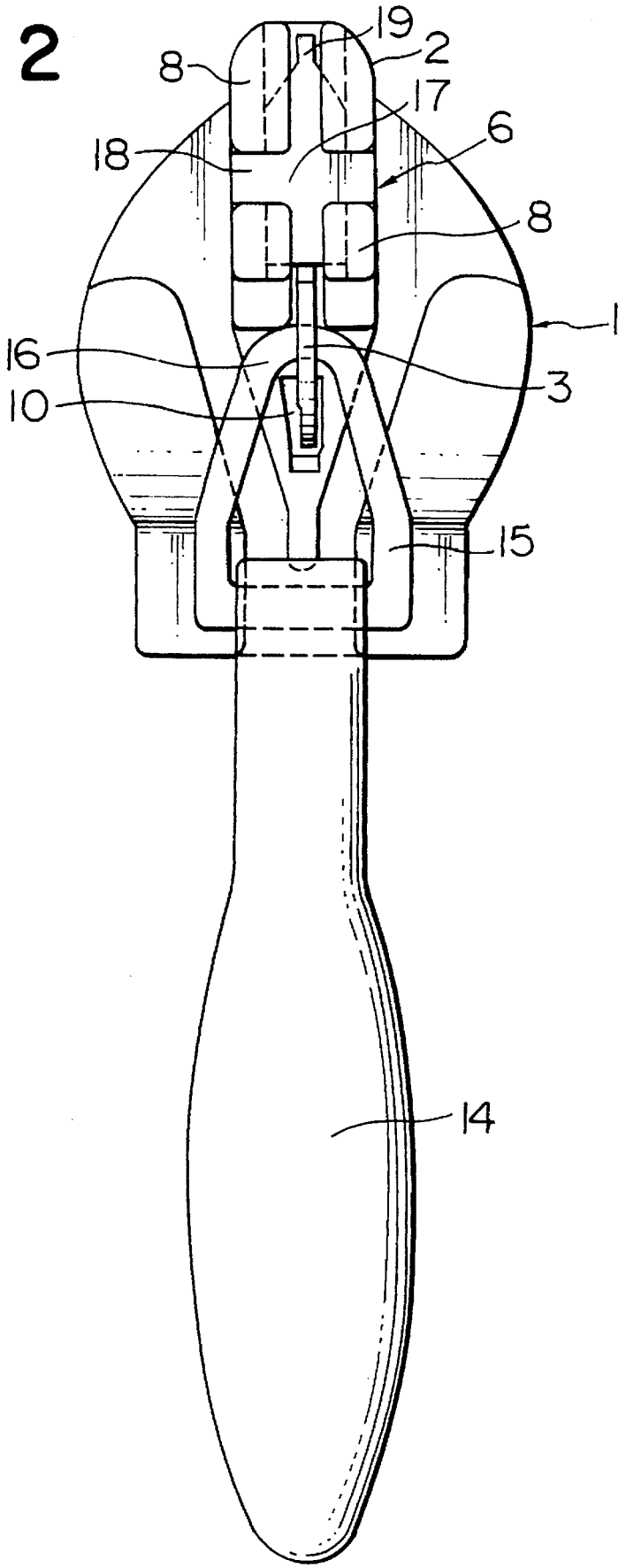
FIG. 2 is a plan view of the auto-lock slider of FIG. 1.
Figure 3:
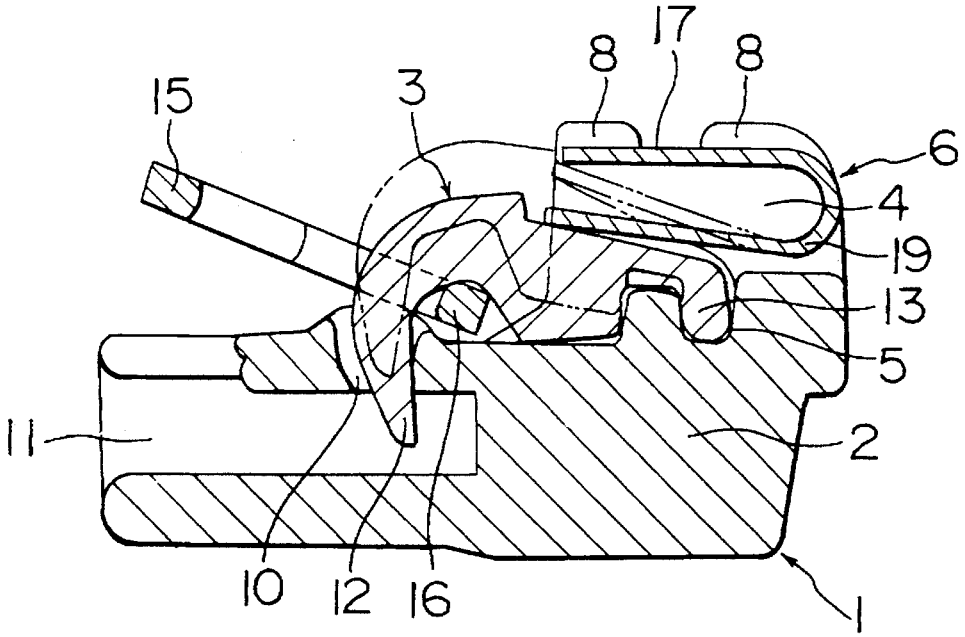
FIG. 3 is a longitudinal cross-sectional view of the auto-lock slider of FIG. 1.

Thus the auto-lock slider of this invention comprises, as shown in FIG. 1, five components: the slider body 1, the locking lever 3, the leaf spring 6, the pull tab 14, and the connecting ring 15. For assembly, firstly the locking lever 3 is inserted into the locking-lever-receiving groove 4 of the guide lug 2, at which time the pintle 16 of the connecting ring 15 is inserted in the base of the locking claw 12 to connect the pull tab 14 to the slider body 1. Then the anchor portion 13 of the locking lever 3 is inserted in the recess 5 of the locking-lever-receiving groove 4, and the locking claw 12 is inserted in the locking claw hole 10. Then the resilient strip 19 of the horizontal U-shape leaf spring 6 is mounted on the slider body 1 in resilient contact with the upper surface of the locking lever 3 with the free end of the resilient poriton 19 facing toward the locking claw 12. At that time, the upper plate 17 is placed in the leaf-spring-receiving portion 7 on the upper surface of the guide lug 2 with the side arms 18 placed on the flat portions 9 between the holding projections 8 of the guide lug 2, whereupon the holding projections 8 are clinched to hold the upper plate 17 in position. Thus the assembling of the slider is completed.

Figure 6:
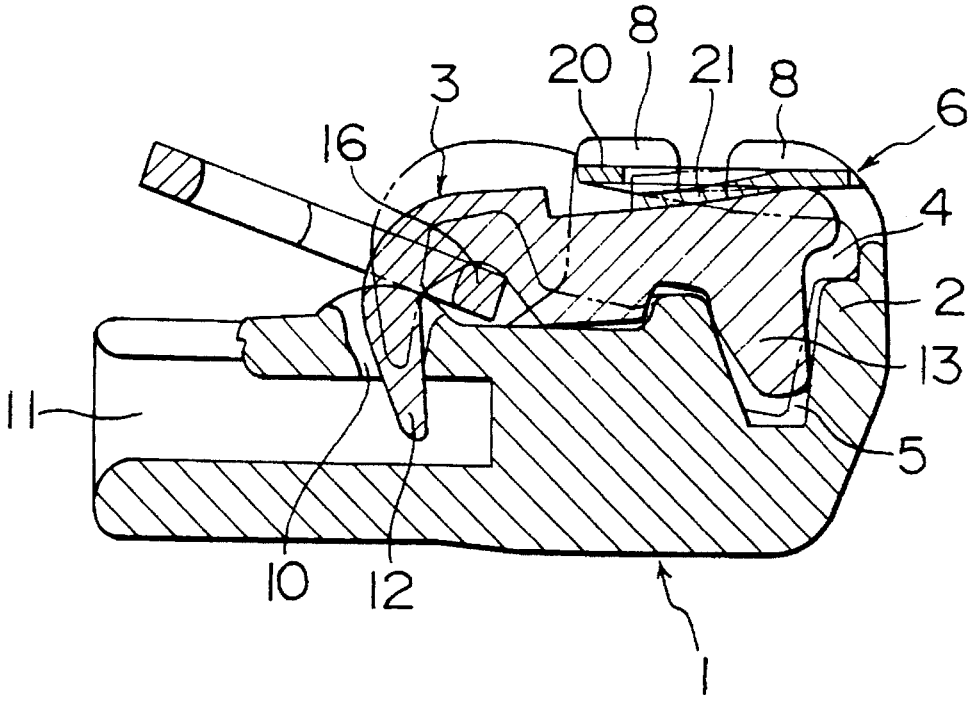
FIG. 6 is a longitudinal cross-sectional view of an auto-lock slider, for a concealed slide fastener, according to another embodiment.

Likewise, for assembling the slider of FIG. 6, firstly the locking lever 3 is placed in the slider body 1, at which time the resilient strip 21 of the leaf spring 6 is placed on the upper surface of the locking lever 3 with the free end of the resilient strip 21 facing toward the locking claw 12. Then the main plate 20 is placed in the leaf-spring-receiving portion 7 on the upper portion of the guide lug 2 with the side arms 22 placed on the flat portions 9 between the holding projections 8 of the guide lug 2, whereupon the holding projections 8 are clinched to hold the main plate 20. Thus the assembling of the slider is completed.

The auto-lock slider constructed as described above has the following results:

According to the first aspect of this invention, the auto-lock slider, for a concealed slide fastener, comprises: a slider body 1 having a guide lug 2 having in its upper portion a locking-lever-receiving groove 4 and a leaf-spring-receiving portion 7; a locking lever 3 received vertically in the locking-lever receiving groove 4, the locking lever 3 having at one end a locking claw 12 and at the other end and anchor portion 13; a leaf spring 6 having a shape such that one end is deformable to a more extent compared to the other end, the leaf spring 6 covering the locking lever 3 at a side toward the anchor portion 13 in such a manner that the anchor portion 13 is pivotably held within the groove 4 and the locking claw 12 is resiliently urged to project into the body 1, the leaf spring 6 being resiliently in contact with the locking lever 3 with the more deformable end facing toward the locking claw 12; and a pull tab connector 15 having a pintle 16 inserted in a base of the locking claw 12. With this auto-lock slider, it is possible to cause the locking lever 3 to act reliable, guaranteeing a smooth operation of the slider. Further, since the anchor portion 13 of the locking lever 3 is covered and protected by the leaf spring 6, the anchor portion 13 is free from being removed from the slider body 1, making the slider more durable. Partly since the number of components of the slider is small, and partly since no assembling process of the slider from the sides is necessary, it is possible to facilitate assembling the slider.

According to the second aspect of the invention, the leaf-spring-receiving portion 7 has front and rear holding projections 8 spaced from one another and projecting from respective upper surfaces of opposite side walls of the locking-lever-receiving groove 4, and the leaf spring 6 has a horizontal U shape composed of a wide upper plate 17 and a narrow resilient strip 19 extending downwardly from the upper plate 17. The upper plate 17 has a pair of side arms 18 projecting centrally from opposite sides of the upper plate 17. The upper plate 17 of the leaf spring 6 is held in position by inserting the side arms 18 between the front and rear holding projections 8 and then clinching the front and rear holding projections 8 over the side arms 18, the resilient strip 19 being pressed against an upper surface of the locking lever 3. With this auto-lock slider, it is possible to mount the horizontal U-shape leaf spring 6, which enables an ideal resilient deformation, in the guide lug 2 accurately and simply in a simple structure.

According to the third aspect of the invention, the leaf spring 6 should by no means be limited to the horizontal U shape and may has an almost closed V shape having a main plate 20 having at its center an resilient strip 21 punched out by a longitudinally elongated horizontal U-shape cut and bent downwardly. This leaf spring 6 also enables an ideal resilient deformation and can be mounted in the guide lug 2 accurately and simply in a simple structure.

What is claimed is:

1. An auto-lock slider, for a concealed slide fastener, comprising:

a slider body having a guide lug having in its upper portion a locking-lever-receiving groove and a leaf-spring-receiving portion;

a locking lever received vertically in said locking-lever-receiving groove, said locking lever having at one end a locking claw and at the other end an anchor portion;

a leaf spring having a shape such that one end is deformable to a greater extent compared to the other end, said leaf spring covering said locking lever at a side toward said anchor portion in such a manner that said anchor portion is pivotally held within said groove and said locking claw is resiliently urged to project into said body, said leaf spring being resiliently in contact with said locking lever with the more deformable end facing toward said locking claw; and a pull tab connector having a pintle inserted in a base of said locking claw;

wherein said leaf-spring-receiving portion has front and rear holding projections spaced from one another and projecting from respective upper surfaces of opposite side walls of said locking-lever-receiving groove and wherein said leaf spring has a horizontal U shape composed of a wide upper plate and a narrow resilient strip extending downwardly from said upper plate, said upper plate having a pair of side arms projecting centrally from opposite sides of said upper plate in a plane including said upper plate, said upper plate of said leaf spring being held in position by inserting said side arms between said front and rear holding projections and then clinching said front and rear holding projections over said wide upper plate, said resilient strip being pressed against an upper surface of said locking lever.

2. The auto-lock slider according to claim 1, wherein said upper surfaces of said opposite side walls of said locking-lever-receiving groove are adapted to support said upper plate such that said clinching of said holding projections secures said upper plate relative to said guide lug.

3. An auto-lock slider, for a concealed slide fastener, comprising:

a slider body having a guide lug having in its upper portion a locking-lever-receiving groove and a leaf-spring-receiving portion;

a locking lever received vertically in said locking-lever-receiving groove, said locking lever having at one end a locking claw and at the other end an anchor portion;

a leaf spring having a shape such that one end is deformable to a greater extent compared to the other end, said leaf spring covering said locking lever at a side toward said anchor potion in such a manner that said anchor portion is pivotally held within said groove and said locking claw is resiliently urged to project into said body, said leaf spring being resiliently in contact with said locking lever with the more deformable end facing toward said locking claw; and pull tab connector having a pintle inserted in a base of said locking claw;

wherein said leaf-spring-receiving potion has front and rear holding projections spaced from one another and projecting from respective upper surfaces of opposite side walls of said locking-lever-receiving groove and wherein said leaf spring has a main plate having at its center a resilient strip punched out by a longitudinally elongated horizontal U-shape cut and bent downwardly, said main plate having a pair of side arms projecting centrally from opposite sides of said main plate, said main plate of said leaf spring being held in position by inserting said side arms between said front and rear holding projections and then clinching said front and rear holding projections over said main plate, said resilient strip being pressed against an upper surface of said locking lever.

4. The auto-lock slider according to claim 3, wherein said upper surfaces of said opposite walls of said locking-lever-receiving groove are adapted to support said main plate such that said clinching of said holding projections secures said main plate relative to said guide lug.

* * * * *